US006994240B2

(12) United States Patent
Jakob et al.

(10) Patent No.: US 6,994,240 B2
(45) Date of Patent: Feb. 7, 2006

(54) SETTING DEVICE

(75) Inventors: Robert Jakob, Feldkirch (AT); Michael Weibel, Wil (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/993,382

(22) Filed: Nov. 19, 2004

(65) Prior Publication Data

US 2005/0092808 A1 May 5, 2005

(30) Foreign Application Priority Data

Nov. 4, 2003 (DE) ..... 103 51 419

(51) Int. Cl.
*B21J 15/28* (2006.01)

(52) U.S. Cl. ..... 227/8; 227/10; 227/107; 227/136; 227/120; 227/138

(58) Field of Classification Search ..... 227/8, 227/10, 107, 136, 120, 138, 147
See application file for complete search history.

(56) References Cited

U.S. PATENT DOCUMENTS 4,197,974 A * 4/1980 Morton et al. ..... 227/8
4,597,517 A * 7/1986 Wagdy ..... 227/8
6,149,046 A * 11/2000 Ho et al. ..... 227/8
6,199,739 B1 * 3/2001 Mukoyama et al. ..... 227/8
6,267,284 B1 * 7/2001 Clark ..... 227/8
6,708,860 B1 * 3/2004 Thieleke ..... 227/8
6,786,378 B2 * 9/2004 Wagdy et al. ..... 227/9
6,796,476 B2 * 9/2004 Birk et al. ..... 227/2
6,913,179 B1 * 7/2005 Chen ..... 227/8
2004/0222266 A1 * 11/2004 Kakuda et al. ..... 227/8

* cited by examiner

*Primary Examiner*—Scott A. Smith
*Assistant Examiner*—Brian Nash
(74) *Attorney, Agent, or Firm*—Ableman, Frayne & Schwab

(57) ABSTRACT

A setting device (10) for driving fastening elements into a receiving material has a housing (11), with a muzzle part (20) which is displaceable axially relative to the housing (11) and is arranged with a guide channel (38) for a fastening element strip (50) and opens into a receiving space (39) for a fastening element (51) to be driven in. Further, a locking element (30) is arranged in the muzzle part (20). The locking element (30) has a feeler portion (33) for detecting a fastening element (51) in the receiving space (39) and a locking part (32) for blocking the displacement of the muzzle part (20) relative to the housing (11) in a locking position (61) when a fastening element (51) is not detected in the receiving space (39) by the feeler portion (33). A blocking member (40) in the muzzle part (20) is movable into the guide channel (38) so as to block the fastening element strip (50). To improve a setting device (10) of this type, the blocking member (40) is in an operative connection with the locking element (30) so that the blocking member (40) can be actuated by the locking element (40).

7 Claims, 6 Drawing Sheets

SETTING DEVICE

BACKGROUND OF THE INVENTION

1. Field of the Invention

The present invention is directed to a setting device for driving fastening elements into a receiving material. Setting devices of this kind can be operated with solid, gaseous or liquid combustible materials or also with compressed air. In combustion-operated setting devices, a setting piston is driven by means of the high-pressure combustion gases. Fastening elements can then be driven into a receiving material by means of the setting piston.

2. Description of the Prior Art

It is known from DE 40 32 200 C2 to provide a setting device with a muzzle part which is displaceable axially relative to a housing of the setting device and which has a receiving space for a fastening element that is to be driven into a receiving material. Further, a contact-pressing feeler is arranged at the setting device and allows a driving-in process when it is displaced relative to the muzzle part when the setting device is pressed against a receiving material. A locking element is provided which blocks the relative displacement of the contact-pressing feeler when there is no fastening element present in the receiving space. A driving-in process or setting process cannot then be initiated with the setting device.

DE 196 42 295 A1 discloses a hand-held, explosive powder-actuated setting device in which a guide channel for fastening elements is formed in a bolt guide constructed as a muzzle part. The muzzle part is displaceable axially relative to a housing of the setting device. Further, a swivelable lever is arranged in the muzzle part. This swivelable lever is swivelable by a control element such that it blocks in the projection of the clear cross-sectional area of the guide channel when the muzzle part is displaced relative to the housing.

In a setting device DXA70R of Hilti Aktiengesellschaft, it is known to provide an arrangement at the muzzle part for detecting fastening elements with a locking element for a contact-pressing feeler, which locking element blocks the contact-pressing feeler when there is no fastening element present in a receiving space at the end of a guide channel for fastening elements. Further, it is known from this reference to provide an arrangement for delaying the forward feed of the fastening elements into the guide channel. A swivelable lever is arranged at the muzzle part and is swiveled into the guide space by a control element when the muzzle part is displaced toward the housing of the setting device when the setting device is pressed against a receiving material. Further transport of fastening elements in direction of the receiving space is blocked in this swiveling position of the lever.

However, it is disadvantageous that the arrangements mentioned above have a large number of structural component parts and take up a large amount of space. Further, increased contact pressing force is required because a plurality of elements must be displaced and/or actuated during the contact-pressing process.

SUMMARY OF THE INVENTION

Therefore, it is the object of the present invention to develop a setting device of the type mentioned above which avoids the disadvantages mentioned above and which can be operated comfortably.

According to the invention, this object is met by a setting device for fastening elements whose significance will be made clear in the following. It is sufficient for this purpose that the blocking member is in an operative connection with the locking element and can be actuated by means of the locking element and can be moved from its releasing position into its blocking position and vice versa. In this way, the quantity of functional parts can be reduced and pressing force can be decreased, which makes comfortable operation possible.

Further, it can be advantageous to provide a control element which is guided so as to be displaceable axially in a guide space in the muzzle part and which is acted upon elastically by a spring element in the direction of its position in which it is moved out of the guide space. In its locking position, the locking element projects with its locking part into the guide space so as to have a blocking effect on the control element. This enables a compact construction of the contact pressing safety device with the locking element.

Further, it can be advantageous when a control surface is arranged at the control element, by which the locking element can be moved from its releasing position into an actuating position in which the feeler part is at a distance from a fastening element located in the receiving space and in which the blocking member is moved into its blocking position by the locking element. For this purpose, the locking part has already advantageously been partly moved out of the guide space beforehand by means of a fastening element in the receiving space. The forward feed delay is likewise indirectly controlled through this step by the locking element by means of the control element cooperating with the locking slide. A separate control is obviated in this way. The muzzle part can be narrower because less constructional space is required.

When the locking element is constructed as a slide element, the necessary pressing force can be reduced to a minimum. The slide element is supported in a displaceable manner particularly in a receptacle of the muzzle part and is supported against the muzzle part, for example, by a spring element.

The blocking member is advantageously constructed as a swivelable catch so that the width of the muzzle part can be reduced.

A reliably functioning conversion of the translatory actuating movement of the locking element into a swiveling movement of the blocking member is ensured when a coulisse device is arranged between the blocking member and the locking element for transmitting an actuating movement from the locking element to the blocking member.

In a low-maintenance variant, the coulisse device comprises a control portion, for example, a coulisse, at the blocking member and a driver, for example, a sliding block, at the locking element, which driver cooperates with the control portion.

BRIEF DESCRIPTION OF THE DRAWING

Further advantages and steps of the invention are indicated in the following description and the drawings. The invention is shown in an embodiment example in the drawings.

DETAILED DESCRIPTION OF THE PREFERRED EMBODIMENT

Figure 1:
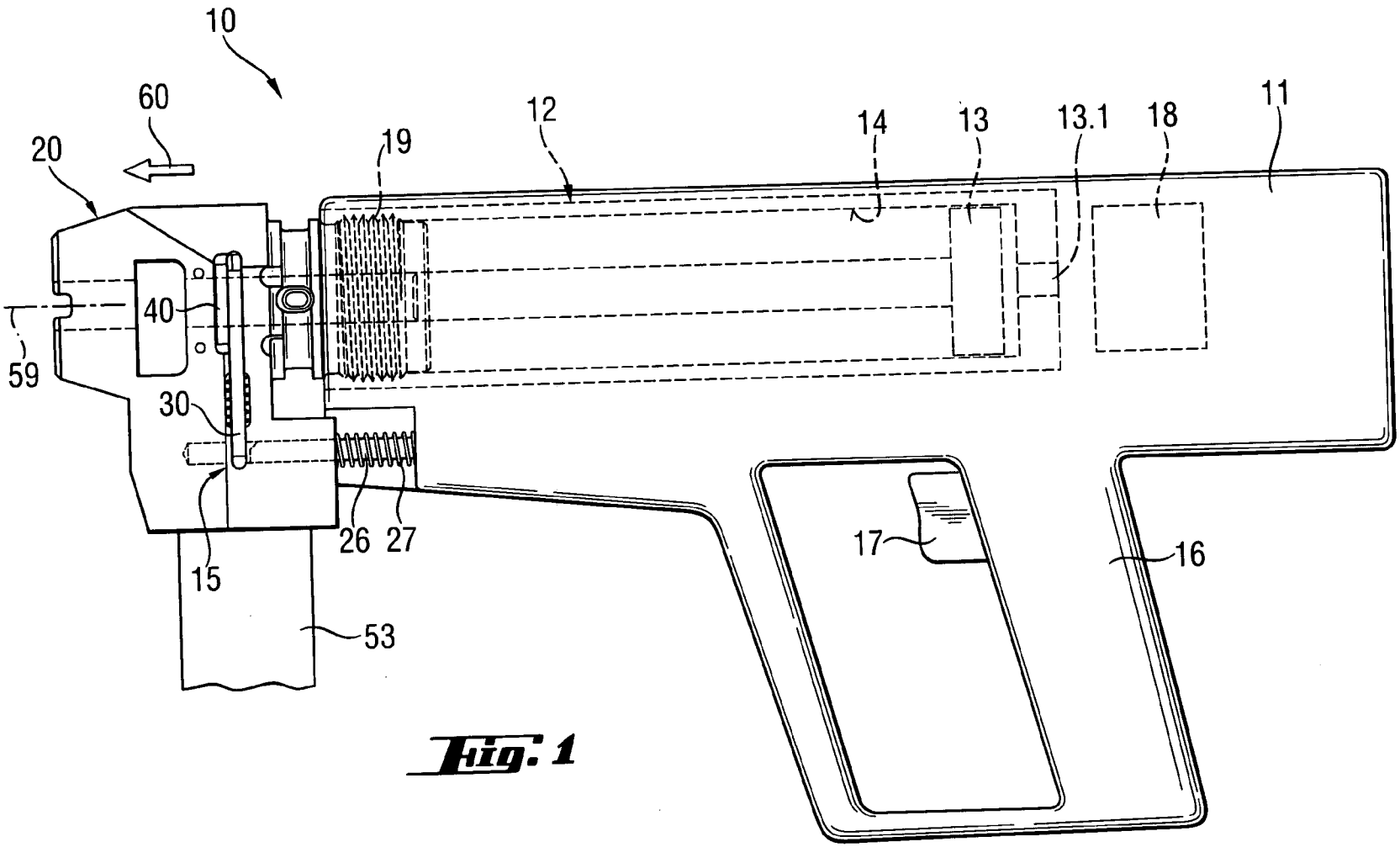
FIG. 1 is a side view of a setting device according to the invention.
Figure 2:
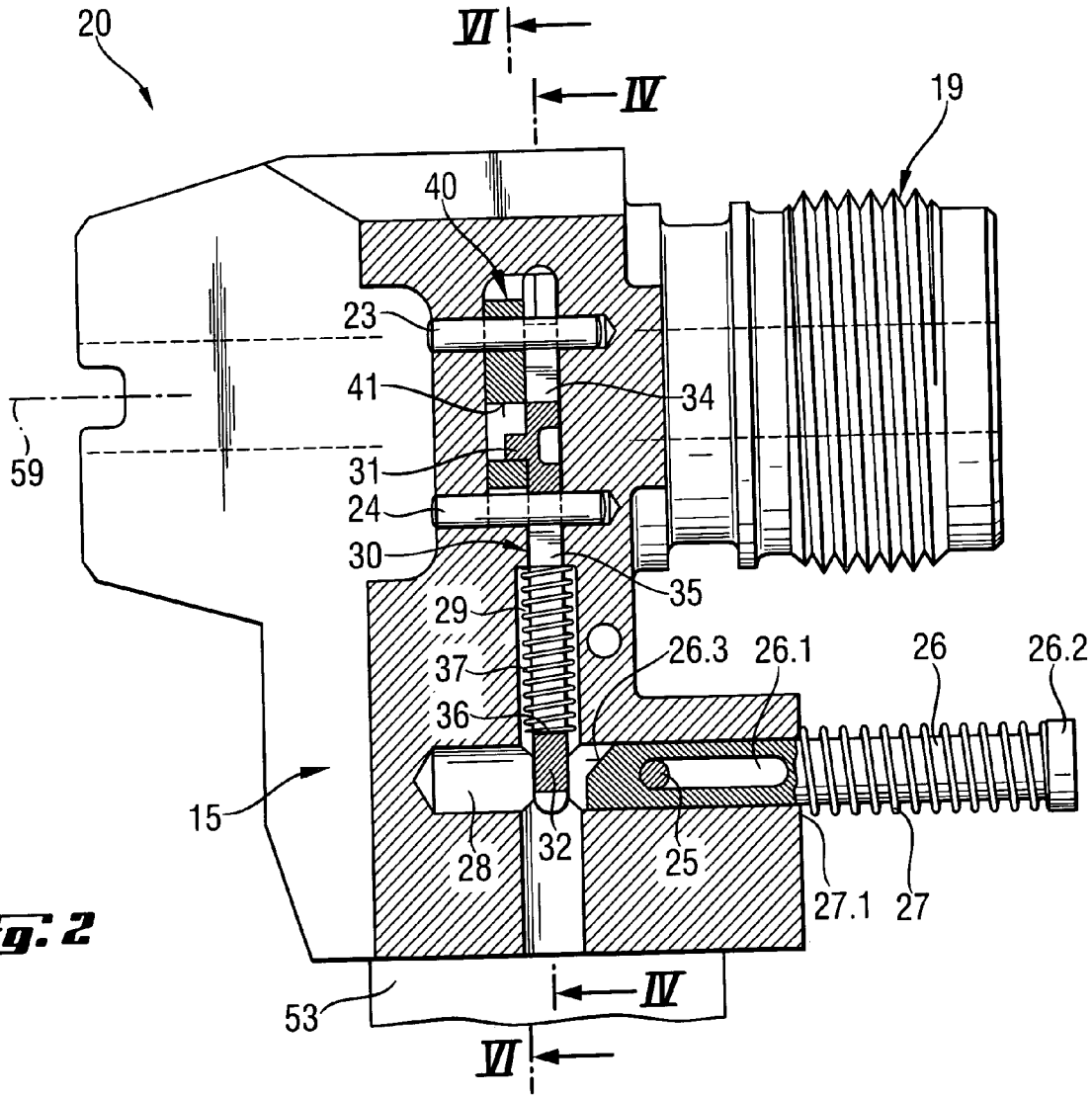
FIG. 2 shows the muzzle part of the setting device from FIG. 1 in section.
Figure 3:
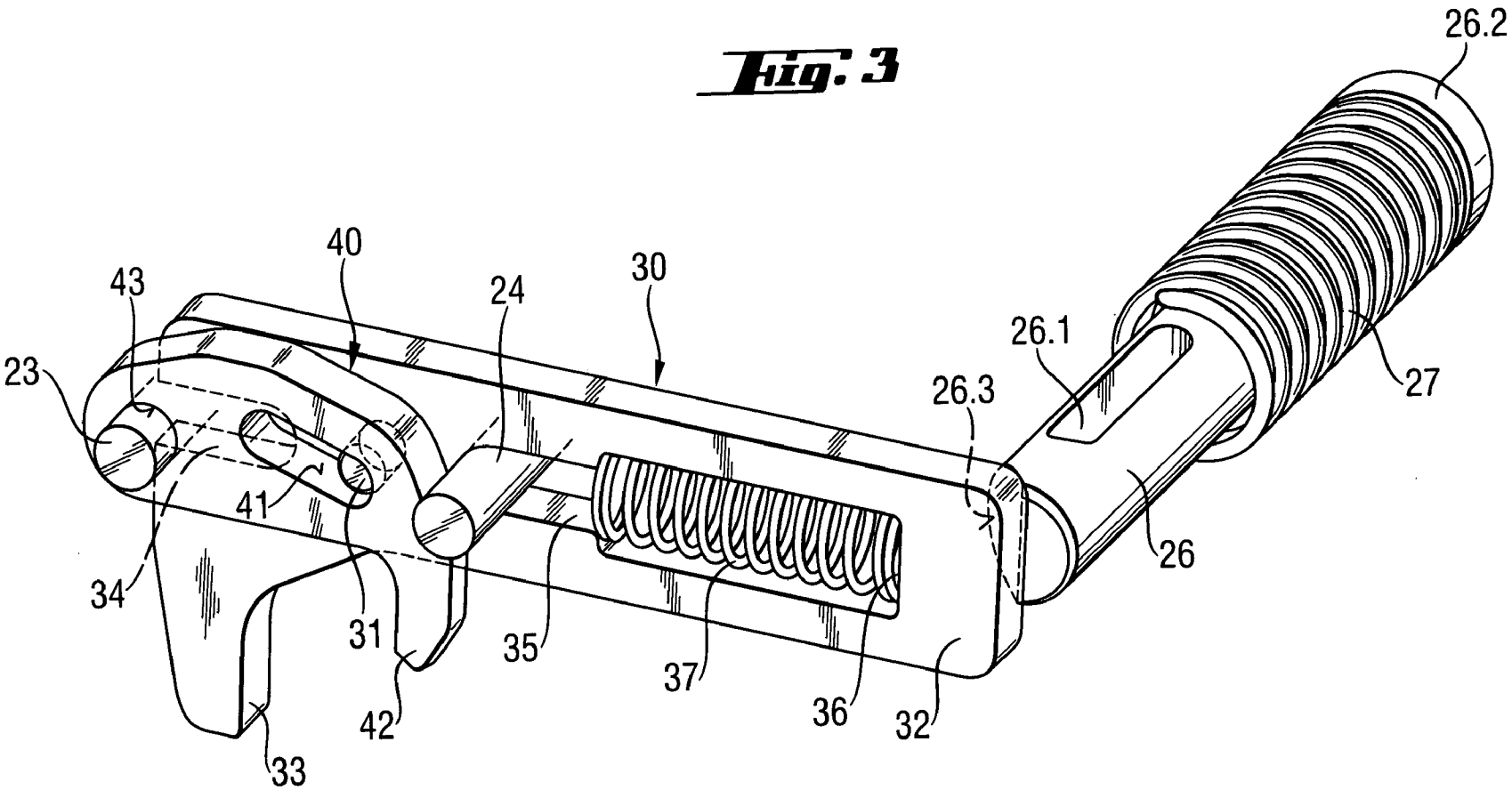
FIG. 3 shows a detail of the muzzle part of the setting device from FIG. 1 in a perspective view.
Figure 4:
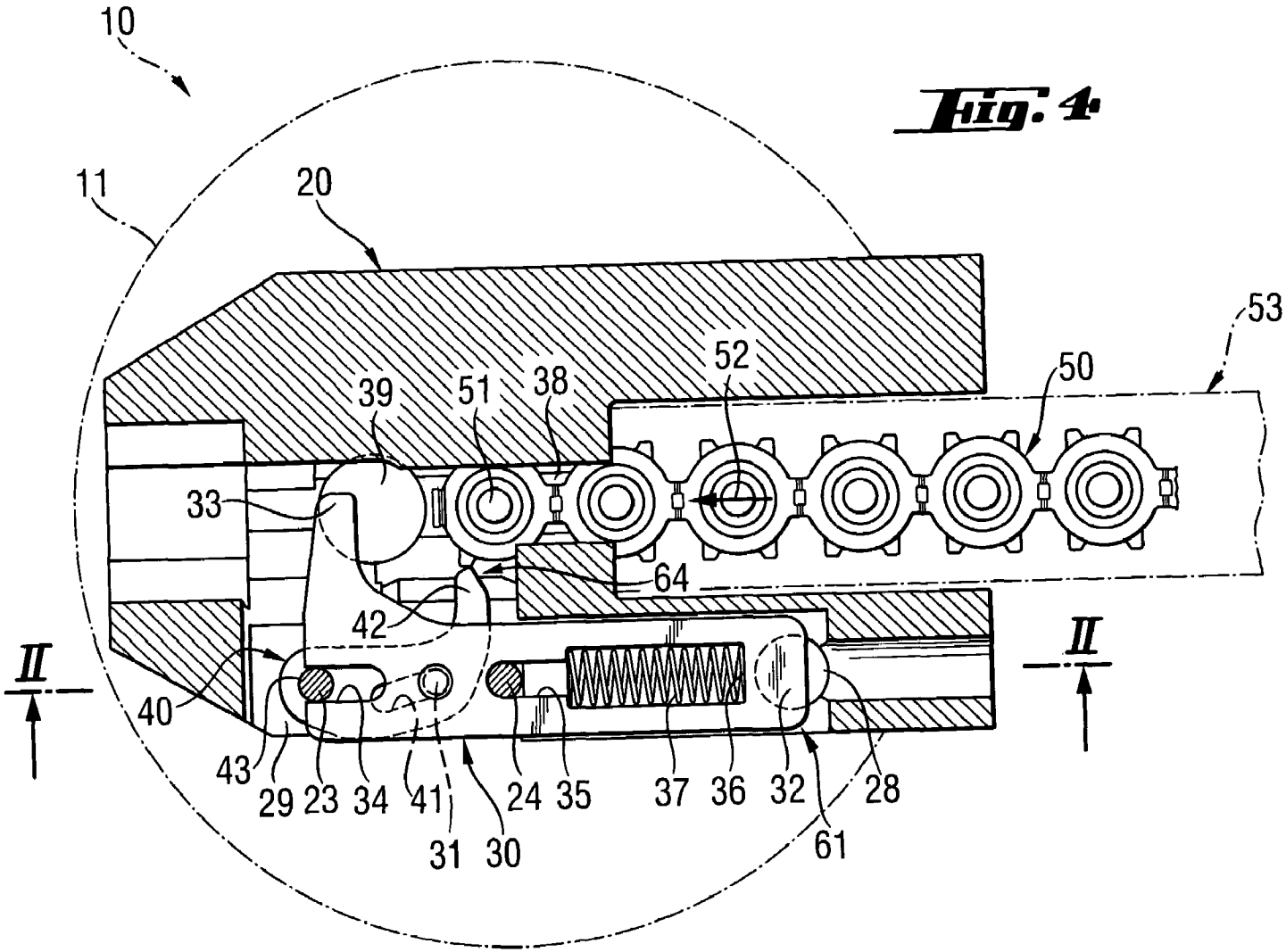
FIG. 4 shows a cross-sectional view of the muzzle part with an empty receiving space and with a fastening element strip in the guide channel according to section IV—IV in FIG. 2.

FIGS. 1 to 8 show a combustion-operated, hand-held setting device 10 by way of example. The setting device 10 has a setting mechanism 12 which is arranged in an axially extending housing 11 with a leading end and a trailing end comprising one or more parts and which has an axially extending setting piston 13 that is guided so as to be displaceable in a piston guide 14 for driving fastening elements 51 into a receiving material indicated in dashes in FIG. 1. A trigger 17 is arranged in a handle 16 of the setting device 10 for initiating a setting process by means of a firing unit 18 for a propellant charge inserted in a cartridge holder 13.1 of the setting mechanism 12.

A muzzle part 20 adjoining the setting mechanism 12 (see especially FIG. 1) is arranged at the setting device 10 at the leading end of the housing 11 in setting direction 60. This muzzle part 20 is connected to the rest of the setting mechanism in the interior of the housing 11, by means of a threaded connection 19. A receiving space 39 which lies on the setting axis 59 defined by the movement path of the setting piston 13 is located in the muzzle part 20. Only a fastening element 51 that is properly positioned in the receiving space 39 can be detected by the setting piston 13 of the setting mechanism 12 and driven into a receiving material. The fastening elements 51 are fed to the receiving space 39 along a guide channel 38 formed in the muzzle part 20. The fastening elements 51 are assembled in a fastening element strip 50 which can be inserted into the guide channel 38 and in which a plurality of fastening elements 51 are arranged in a carrier element. The fastening element strip 51 can be fed to the muzzle part 20 by means of a magazine 53 which can be connected to the muzzle part 20 and in which the fastening element strip 51 is spring-loaded in the direction of the receiving space 39.

An arrangement, designated in its entirety by 15, is arranged at the muzzle part 20 for detecting a fastening element 51 in the receiving space 39 of the muzzle part 20 and for blocking the transport of a fastening element strip 50 located in the guide channel 38 of the muzzle part 20. This arrangement 15 ensures that a setting process can be initiated only when a fastening element 51 is present in the receiving space 39 and the setting device 10 is pressed against a receiving material. Further, it prevents the fastening element strip 50 from moving back in direction of the receiving space 39 during the setting process.

The arrangement 15 comprises a locking element 30 which is constructed in this case as a slide element. The locking element 30 is located in an open receptacle 29 of the muzzle part 20. It is mounted in the latter so as to be displaceable in a limited manner by two bearing pins 23, 24. For this purpose, the locking element 30 has two guide portions 34, 35 in which the bearing pins 23, 24 engage. Further, a contact point 36 for a spring element 37 by which the locking element 30 is elastically supported at the muzzle part 20 at the support point 37.1 is arranged at the locking element 30. The locking element 30 is acted upon in the direction of a locking position 61 (see FIG. 4) by the spring element 37, in which locking position 61 the locking element 30 projects with its locking portion 32 into the movement path of a control element 26 (see FIG. 2). This control element 26 is displaceably guided in a cylindrical guide space 28, for example, a bore hole, of the muzzle part 20 and is essentially pin-shaped in the present instance. The control element 26 is elastically supported against the muzzle part 20 by a spring element 27 that is arranged between a projection 26.2 of the control element 26 and a support point 27.1 of the muzzle part 20 (see FIG. 2). The control element 26 is held at the muzzle part 20 by a bearing pin 25 of the muzzle part 20 that is guided in an elongated hole 26.1 of the control element 26 and, at the same time, the displacement path of the control element 26 in the guide space 28 is limited by means of this bearing pin 25. At its end facing the locking element 30, the control element 26 has a control surface 26.3 which is constructed as an inclined surface and which can cooperate with the locking portion 32 of the locking element 30 as will be further explained in the following. Further, a blocking member 40 (see FIGS. 2 and 3) which is constructed as a blocking lever in the present instance is arranged adjacent to the locking element 30 in the receptacle 29 in the muzzle part 20. The blocking member 40 is swivelably mounted on a bearing 43 on the bearing pin 23 and has a control portion 41 which is constructed as a coulisse and in which a driver 31 of the locking element 30 engages, this driver 31 being constructed as a slide block. Further, the blocking member 40 has a blocking portion 42 which can be swiveled into the guide channel 38 (see FIG. 4) so as to form a block. In the position, of the setting device 10 shown in FIGS. 1 to 4 in which there is no fastening element 51 present in the receiving space 39, the blocking member 40 is in its swiveled out position 64 (FIG. 4) in which a movement of a fastening element strip 50 in the transporting direction 52 toward the receiving space 39 is possible.

Figure 5:
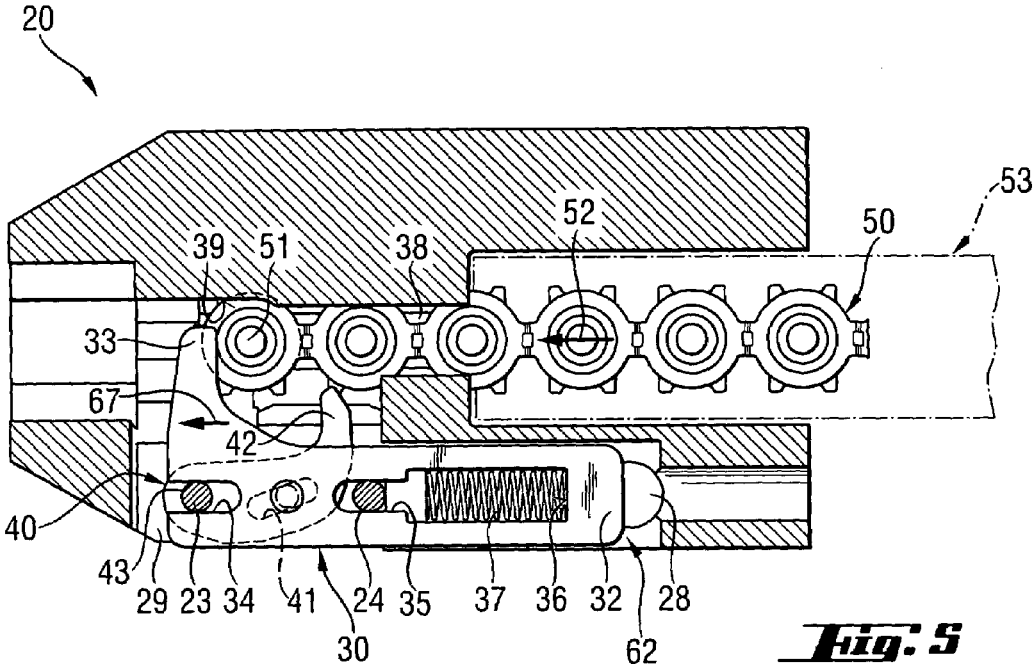
FIG. 5 shows a cross-sectional view of the muzzle part in a sectional position corresponding to FIG. 4 with a fastening element strip in the guide channel and with a fastening element in the receiving space.
Figure 6:
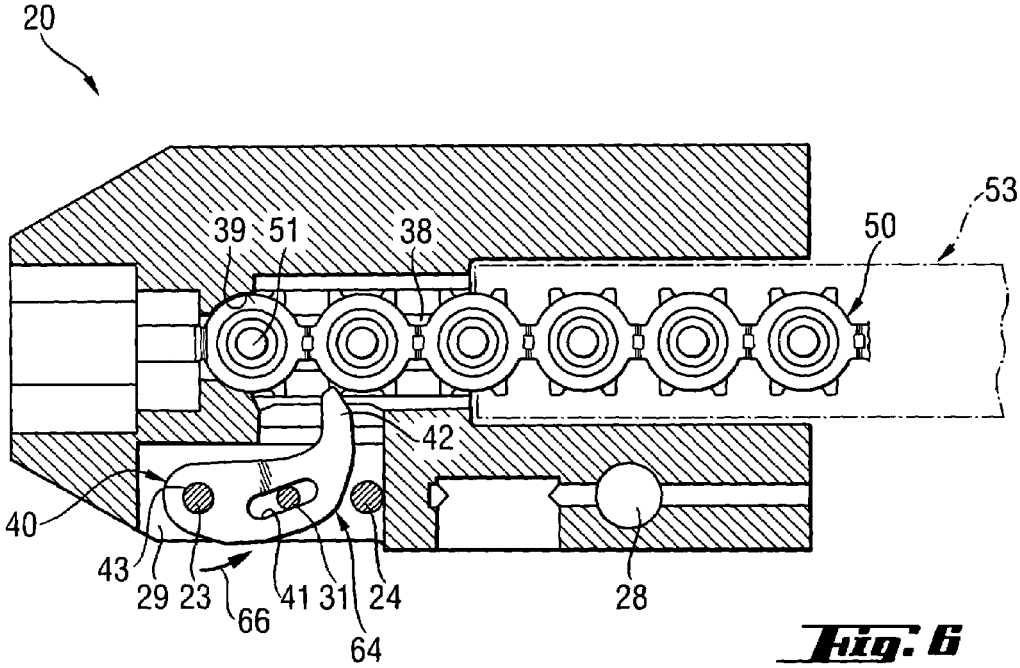
FIG. 6 shows a cross-sectional view, according to section line VI—VI in FIG. 2, of the muzzle part with a fastening element strip in the guide channel and with a fastening element in the receiving space in a displaced sectional position in relation to FIG. 5.

When the fastening element strip 50 is transported in the guide channel 38 in the transporting direction 52 (FIG. 4) up to the receiving space 39 so that a fastening element 51 is located in the receiving space 39, the locking element 30 is moved in the displacement direction 67 (FIG. 7) along a guide portion 33 which detects the fastening element 51 and is moved into its releasing position 62 as can be seen from FIG. 5. In this releasing position 62 of the locking element 30, the locking part 32 no longer blocks the movement path of the control element 26 in the guide space 28. It is now possible to press the setting device 10 against a receiving material to prepare for a setting operation because the muzzle part 20 can now be displaced toward the housing 11. As can be seen from FIG. 6, the blocking member 40 is also swiveled some distance in swiveling direction 66 by means of the driver 31 engaging in the control portion 41; however, it does not yet engage completely in the guide channel 38 with its blocking part 42.

Figure 7:
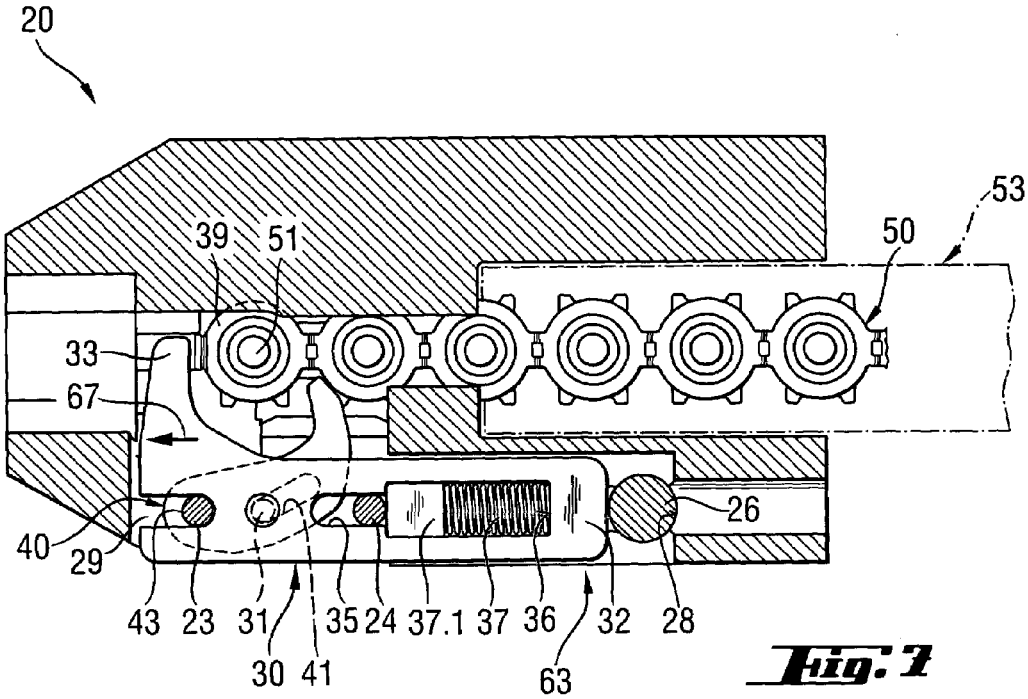
FIG. 7 shows a cross-sectional view of the muzzle part corresponding to FIG. 5, wherein the setting device is pressed against a receiving material.
Figure 8:
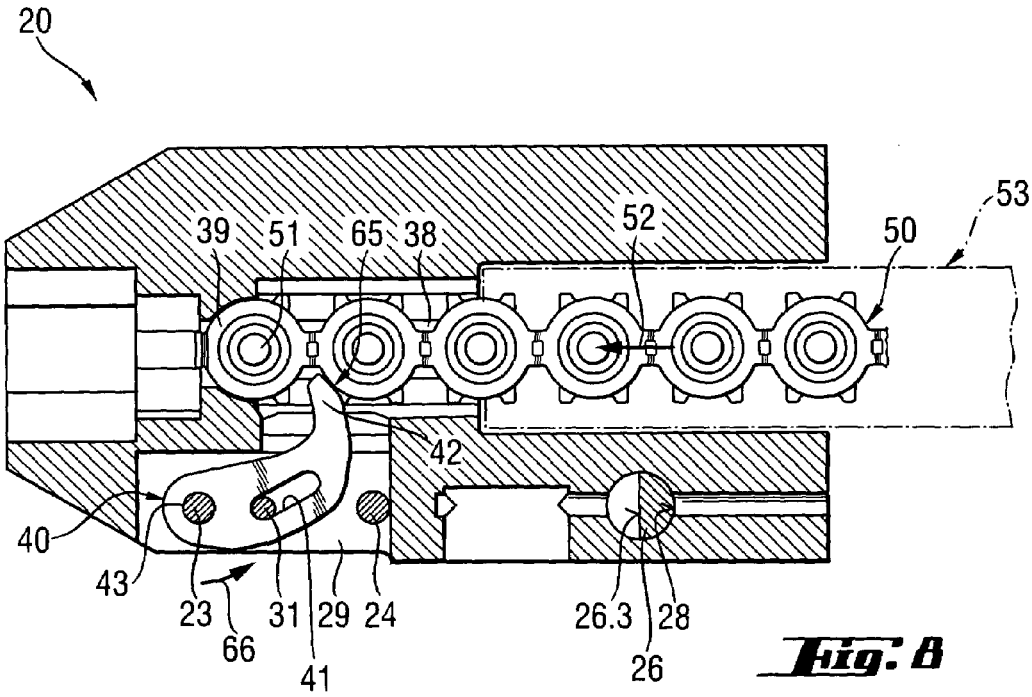
FIG. 8 shows a cross-sectional view of the muzzle part corresponding to FIG. 6, wherein the setting device is pressed against a receiving material.

FIGS. 7 and 8 show the setting device 10 in a state in which its is pressed against a receiving material. As can be seen from FIG. 7, the locking element 30 has been moved farther in the displacing direction 67 into its actuating position 63 at its locking portion 32 by the control surface 26.3 of the control element 26. Accordingly, on the one hand, the fastening element 51 in the receiving space 39 is completely released so that the setting piston 13 can run past the feeler portion 33 of the locking element 30 without obstruction in a subsequent setting process. On the other hand, as can be seen from FIG. 8, the blocking member 40 has been swiveled in swiveling direction 66 into its blocking position 65 by means of the driver 31 of the locking element 30 which engages in the control portion 41 of the blocking member 40. In this blocking position 65, the blocking member 40 lies with its blocking part 42 in the guide channel 38 and engages at the fastening element strip 50 in a blocking manner. The next, fastening element 51 of the fastening element strip 50 cannot be transported in transporting direction 52 into the receiving space 39 after the setting process has been carried out as long as the setting device 10 remains pressed against the receiving material. Further transport of the arrangement 15 is allowed only when the setting device 10 has been lifted from the receiving material and the locking element 30 and blocking member 40 of the arrangement 15 are moved again into the starting position. The next fastening element 51 can be transported into the setting position in the receiving space 39 by the forward feed force of the magazine 53 when the setting device 10 is again pressed against a receiving material.

What is claimed is:

1. Setting device for driving fastening elements into a receiving material comprising a housing (11) having an axially extending setting direction with a leading end and a trailing end, a muzzle part (20) mounted on the leading end of said housing and axially displaceable relates to said housing (11), said muzzle part (20) has a guide channel (38) for a fastening element strip (50) and opens into a receiving space (39) for a fastening element to be driven into the receiving material, and a locking element (30) with a feeler part (33) for detecting a fastening element (51) in the receiving space (39) and a locking part (32) for blocking the displacement of said muzzle part (20) relating to the housing (11) in a locking position (61) when a fastening element (51) is not detected in the receiving space (39) by said feeler part (33), a blocking member (40) movable into said guide channel (38) to block said fastening element strip (50), and the blocking member (40) is in an operative connection with the locking element (30) and is actuatable by said locking element (30).

2. Setting device, as set forth in claim 1, wherein a control element (26) is guided for axial displacement in an axially extending guide space (28) in said muzzle part (20) and is acted on elastically by a spring element (27) in the direction out of said guide space (28), wherein said locking element (30) projects with the locking part (32) into the guide space (28) for providing a blocking effect on said control element (26) in the locking position (61) of said locking element (30).

3. Setting device, as set forth in claim 2, wherein a control surface (26.3) on said control element (26) so that said locking element (30) can be moved into an actuating position (63) with said feeler part (33) at a distance from a fastening element (51) located in said receiving space (39) and said blocking member (40) is moved into the blocking position (65) thereof by said locking element (30).

4. Setting device, as set forth in claim 3, wherein said locking element (30) is formed as a slide element.

5. Setting device, as set forth in claim 3, wherein said blocking member (40) is formed as a swivelable catch.

6. Setting device, as set forth in claim 5, wherein a coulisse device is arranged between said blocking member (40) and said locking element (30) for transmitting an actuating movement from said locking element (30) to said blocking member (40).

7. Setting device, as set forth in claim 6, wherein said coulisse device comprises a control part (41) on the blocking member (40) and a driver (31) on said locking element (30) where said driver (31) cooperates with said control part (41).

* * * * *